US005356358A

United States Patent [19]

Chen

[11] Patent Number: 5,356,358

[45] Date of Patent: Oct. 18, 1994

[54] HORSE-RIDING TYPE EXERCISER

[76] Inventor: Paul Chen, No. 3-6, Ching Yang Rd. Liu Pao Village, Ta Ya Hsiang, Taichung Hsien, Taiwan

[21] Appl. No.: 208,135

[22] Filed: Mar. 8, 1994

[51] Int. Cl.[5] ..... A63B 69/06; A63B 21/068

[52] U.S. Cl. ..... 482/96; 482/72; 482/57

[58] Field of Search ..... 482/57, 95, 96, 72; 280/1.182, 1.183, 1.204, 1.192, 1.203

[56] References Cited

U.S. PATENT DOCUMENTS

| | | | |
|---|---|---|---|
| 4,300,760 | 11/1981 | Bobroff | 482/96 |
| 4,743,010 | 5/1988 | Geraci | 482/95 |
| 5,299,997 | 4/1994 | Chen | 482/72 |

FOREIGN PATENT DOCUMENTS

| | | | |
|---|---|---|---|
| 0474691 | 6/1951 | Canada | 482/96 |

*Primary Examiner*—Stephen R. Crow

*Attorney, Agent, or Firm*—Peterson, Wicks, Nemer & Kamrath

[57] ABSTRACT

A horse-riding type exerciser includes a base frame having a pair of elongated beam elements which each have a distal end extending upwardly therefrom. A drive post device has a mediate portion pivotally engaged between the two distal ends of the pair of beam elements. A handlebar is mounted to an upper portion of the drive post device and a pair of foot rests is pivotally mounted to a lower portion of the drive post device. A seat post device has a lower portion pivotally engaged with the base frame between the pair of beam elements. A bracket device is pivotally engaged with an upper portion of the seat post device. A seat element is securely mounted on the bracket device. A connecting device has a first end pivotally engaged with the lower portion of the drive post device and a second end pivotally engaged with a mediate portion of the seat post device.

6 Claims, 5 Drawing Sheets

HORSE-RIDING TYPE EXERCISER

BACKGROUND OF THE INVENTION

1. Field of Invention

The present invention relates to a horse-riding type exerciser which is able to provide an exercise similar to horse-riding.

2. Related Prior Art

The closest prior art of a horse-riding type exerciser is disclosed in the Applicant's own copending patent application, U.S. Ser. No. 08/111,101, filed Aug. 24, 1993, now U.S. Pat. No. 5,299,997. However, such an arrangement has a more complex structure and transmission procedures. Moreover, such an arrangement is not able to produce a varying and adjustable resistance effect and is not suitable for users of different heights.

The present invention has arisen to mitigate and/or obviate the afore-mentioned disadvantages of the conventional exerciser.

SUMMARY OF THE INVENTION

The primary objective of the present invention is to provide a horse-riding type exerciser.

Another objective is to provide a horse-riding type exerciser which has a simple structure and is able to easily perform its function in a simple transmission fashion.

A further objective is to provide a horse-riding type exerciser which is able to utilize a user's bodily weight to form a natural resistance effect without using additional resistance means on the exerciser.

A further objective is to provide a horse-riding type exerciser which is able to produce a varying and adjustable resistance action by use of a plurality of weight elements.

A further objective is to provide a horse-riding type exerciser which is suitable for users of different heights.

In accordance with one aspect of the present invention, there is provided a horse-riding type exerciser comprising a base frame having a pair of elongated beam elements which each have a distal end extending upwardly therefrom. A drive post means has a mediate portion pivotally engaged between the two distal ends of the pair of beam elements. A handlebar is mounted to an upper portion of the drive post means and a pair of foot rests is pivotally mounted to a lower portion of the drive post means. A seat post means has a lower portion pivotally engaged with the base frame between the pair of beam elements. A bracket means is pivotally engaged with an upper portion of the seat post means. A seat element is securely mounted on the bracket means. A connecting means has a first end pivotally engaged with the lower portion of the drive post means and a second end pivotally engaged with a mediate portion of the seat post means.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
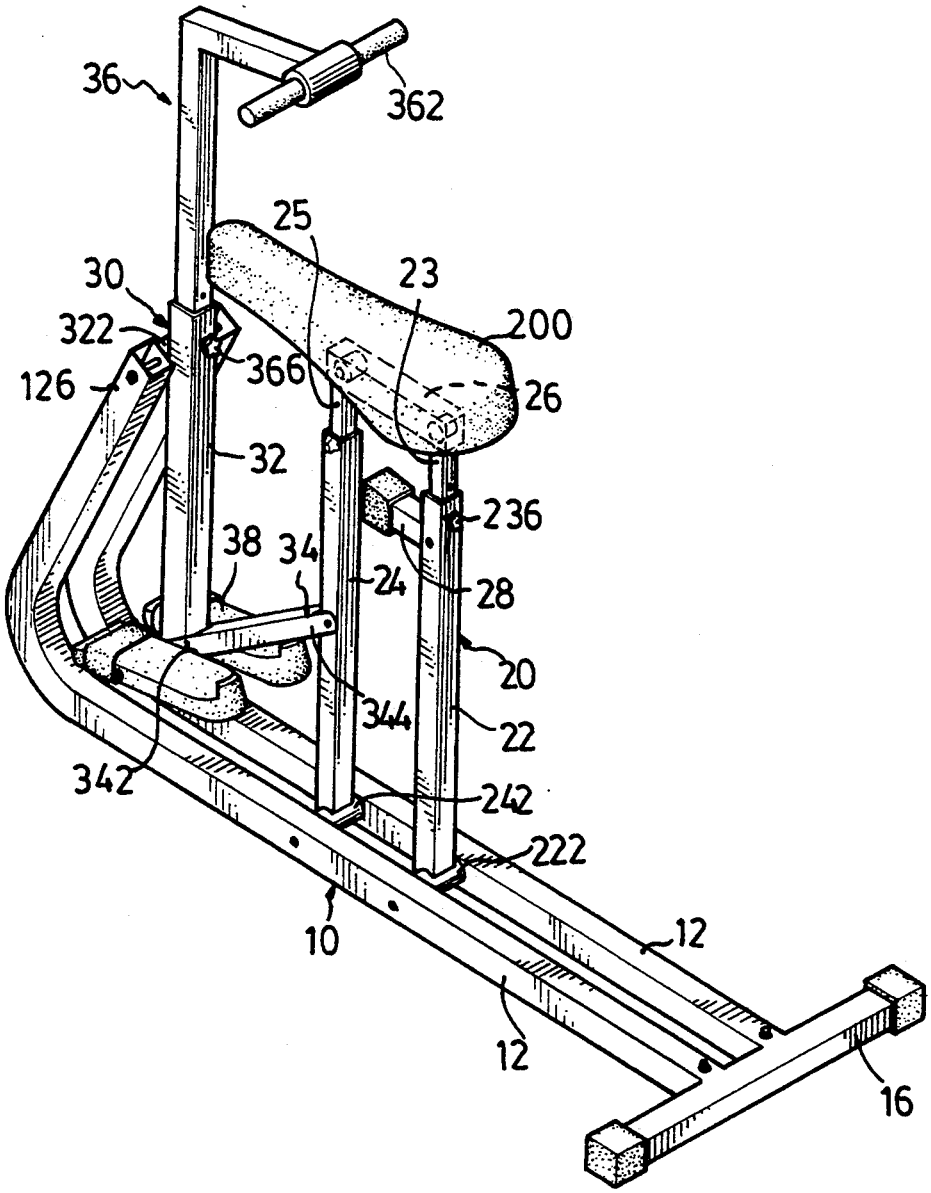
FIG. 1 is a perspective view of a horse-riding type exerciser in accordance with the present invention.

Referring to the drawings, and particularly referring to FIG. 1, a horse-riding type exerciser in accordance with a first embodiment of the present invention includes a base frame 10 comprising a pair of elongated beam elements 12 which each have a distal end 126 extending upwardly therefrom in a tilting fashion. Each of the distal ends 126 is preferably formed with a hole therein. A horizontal elongated rod 16 is formed integrally to one end of the pair beam elements 12 for supporting the base frame 10. Preferably, a drive post means 30 has a lower portion 32 and an L-shaped upper portion 36 which is adjustably received in the lower portion 32 and is retained in position by a knob 366 passing through a hole formed in the lower portion 32 and through one of a plurality of threaded holes formed in the L-shaped upper portion 36 such that the drive post means 30 is suitable for users of different arm lengths.

A pivot axle 322 is securely mounted to a mediate portion of the drive post means 30 and is pivotally engaged with the two distal ends 126 through the two holes therein such that the drive post means 30 is pivotally engaged with the base frame 10 between the two distal ends 126 of the pair of beam elements 12. A handlebar 362 is mounted to the L-shaped upper portion 36 of the drive post means 30. A pair of foot rests 38 are pivotally mounted to the lower portion 32 of the drive poet means 30. Furthermore, the force required to actuate the exerciser varies as the length of the force arm (from the handlebar 362 to the pivot axle 322 ) changes when the position of the upper portion 36 relative to the lower portion 32 changes, thus serving the same effect as the variable resistance used in conventional exerciser.

A first axle 242 and a second axle 222 are rotatably mounted to a mediate portion of the base frame 10 between the pair of beam elements 12. A seat post means 20 comprises a first seat post 24 and a second seat post 22 respectively securely attached to the first and second axles 242 and 222 to pivot therewith. In addition, a rod 28 is securely mounted to an upper portion of the second seat post 22 in a perpendicular fashion. A first adjustable post 25 and a second adjustable post 23 are respectively adjustably received in the first and second seat posts 24 and 22 and are pivotally engaged with a bracket means 26. A seat element 200 is securely mounted on the bracket means 26.

Preferably, the first adjustable post 25 is retained in position by a knob 256 (not shown in FIG. 1) passing through a hole formed in the first seat poet 24 and through one of a plurality of screwed holes formed in the first adjustable post 25. In a similar fashion, the second adjustable post 23 is retained in place by a knob 236 passing through a hole formed in the second seat post 24 and through one of a plurality of threaded holes formed in the second adjustable post 25 such that the height of the seat element 200 is adjustable for users of different heights.

A connecting means 34 has a first end 342 pivotally engaged with the lower portion 32 of the drive post means 30 and a second end 344 pivotally engaged with a mediate portion of the first seat post 24.

Figure 2:
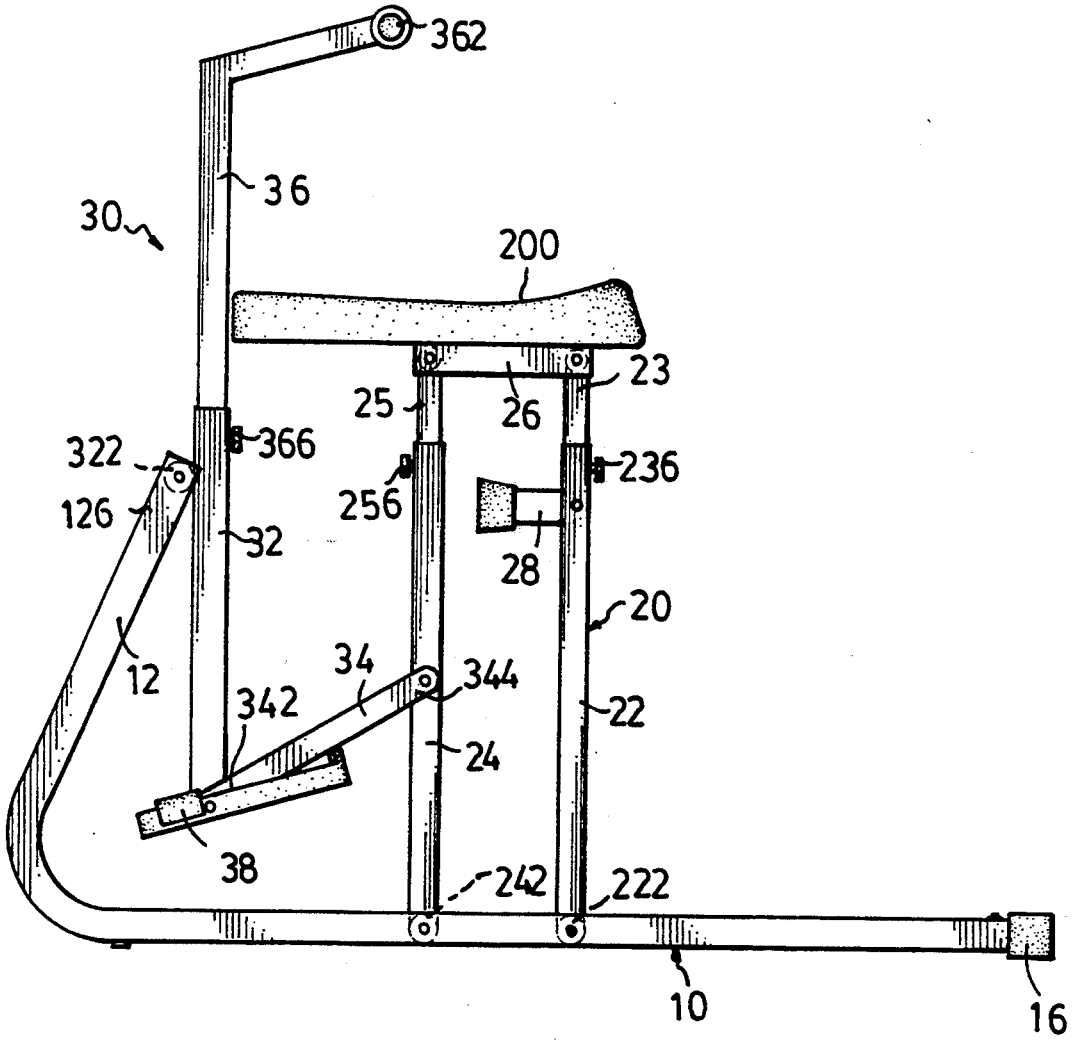
FIG. 2 is front plan view of the horse-riding type exerciser as shown in FIG. 1 in accordance with a first embodiment of the present invention.
Figure 3:
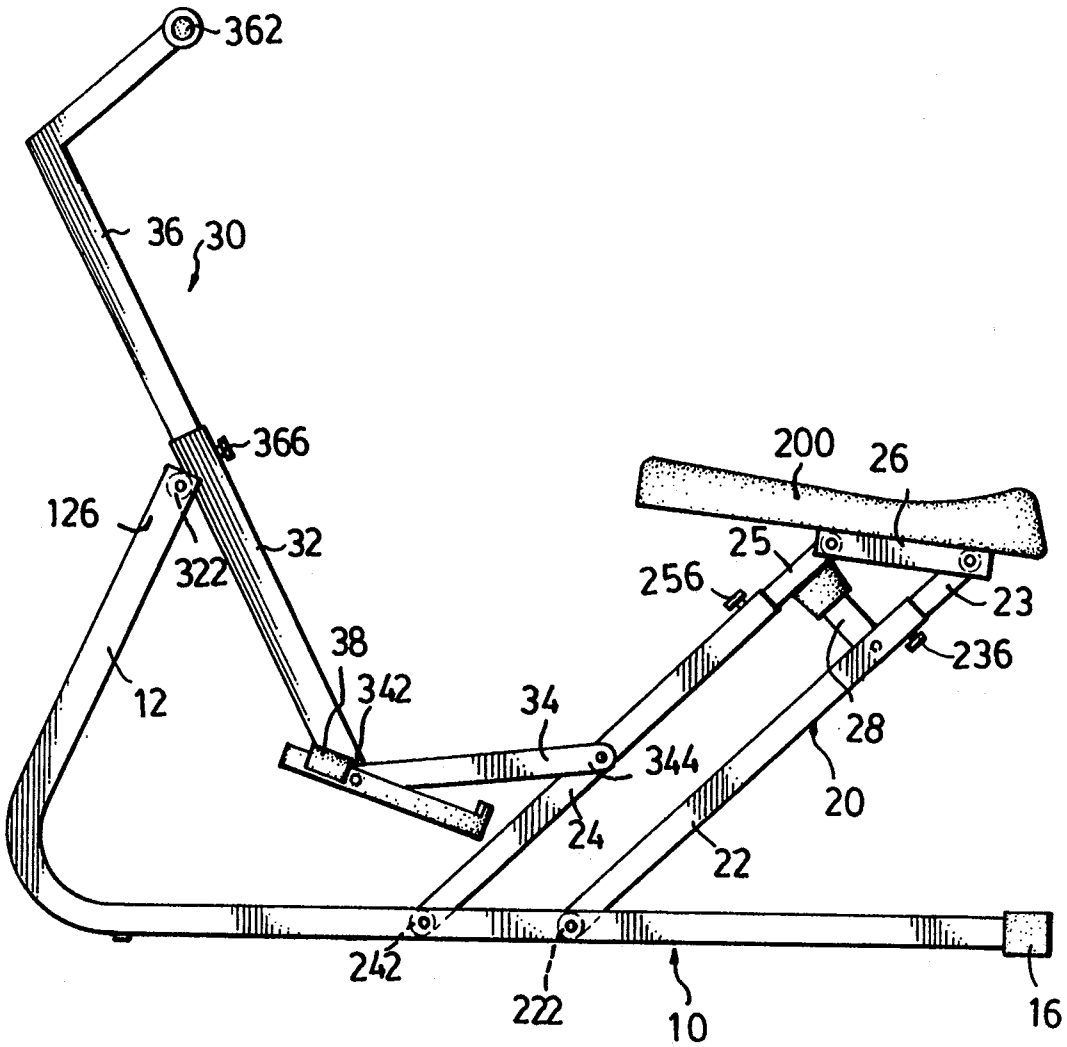
FIG. 3 is front plan view of the horse-riding type exerciser showing the exerciser in an action mode.

In operation, firstly referring to FIG. 2, a user initially "rides" on the seat element 200 with his two feet placed on the foot rests 38, and with his two hands holding the handlebar 362. Thereafter, by exerting a forward force by the two hands to the handlebar 362, the drive post means 30 is pivoted counterclockwise about the pivot axle 322, thus causing the connecting means 34 to pivot relative the drive post means 30, thereby driving the first seat post 24 to pivot clockwise about the first axle 242 while the second seat post 22 synchronously pivots therewith about the second axle 222 such that the seat element 200 is displaced backward relative to the base frame to a status as shown in FIG. 3. Further referring to FIG. 3, it can be seen that the rod 28 functions as a buffer against the first adjustable post 25 when the exerciser is in an extended position.

Reversely, the handlebar 362 is pulled backward by the user's two hands with his two feet still placed on the foot rests 38 such that the drive seat post 30 is pivoted clockwise about the pivot axle 322, thus causing the connecting means 34 to pivot relative to the drive seat post 30 , thereby driving the first seat post 24 to pivot counterclockwise about the first axle 242 while the second seat post 22 synchronously pivots therewith about the second axle 222 such that seat element 200 is moved to the original status as shown in FIG. 2. The above-mentioned process is continuously repeated.

Figure 4:
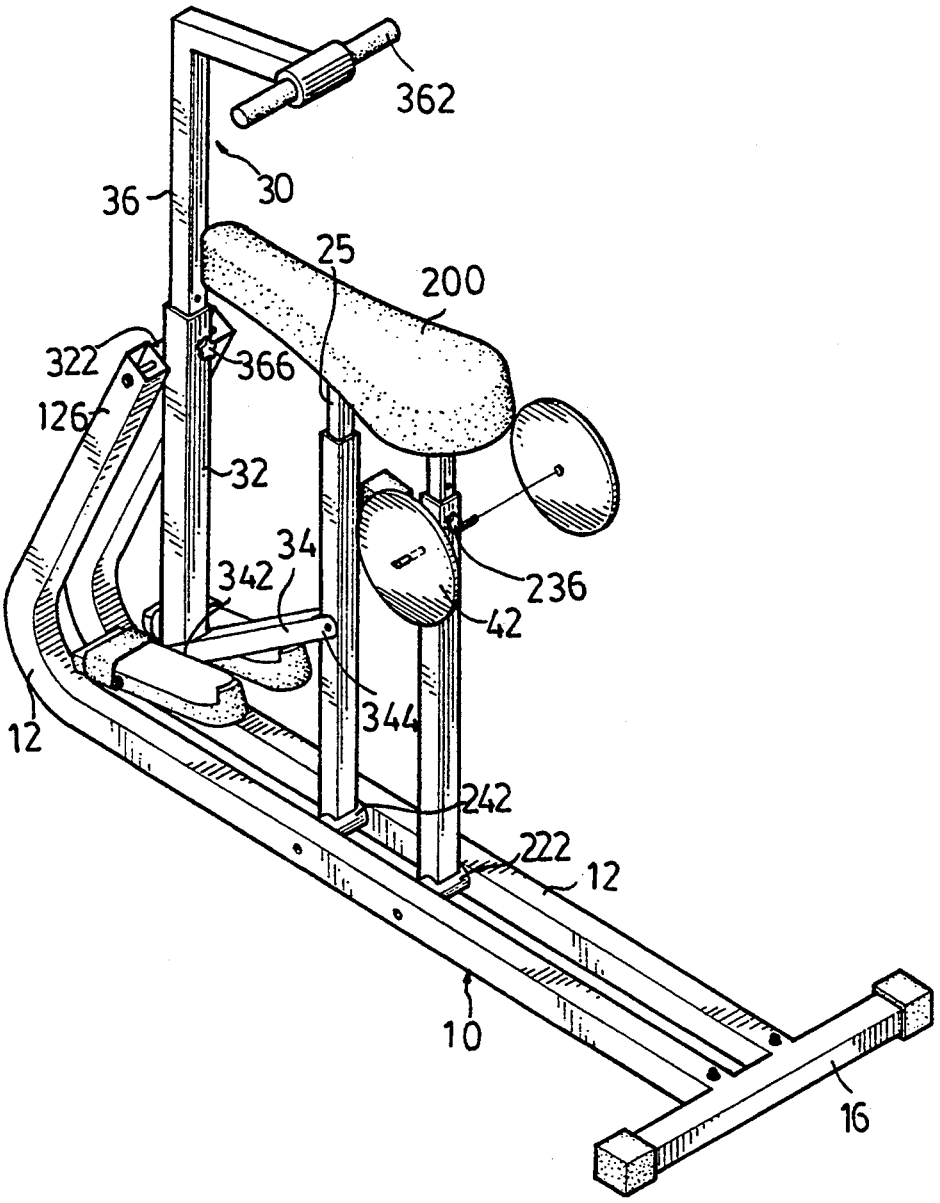
FIG. 4 is a perspective view of the horse-riding type exerciser as shown in FIG. 1, showing a pair of weight elements mounted to the exerciser.

Particularly referring to FIG. 4, a plurality, for example two, of weight elements 42 are mounted to an upper portion of the second seat post 22.

Figure 5:
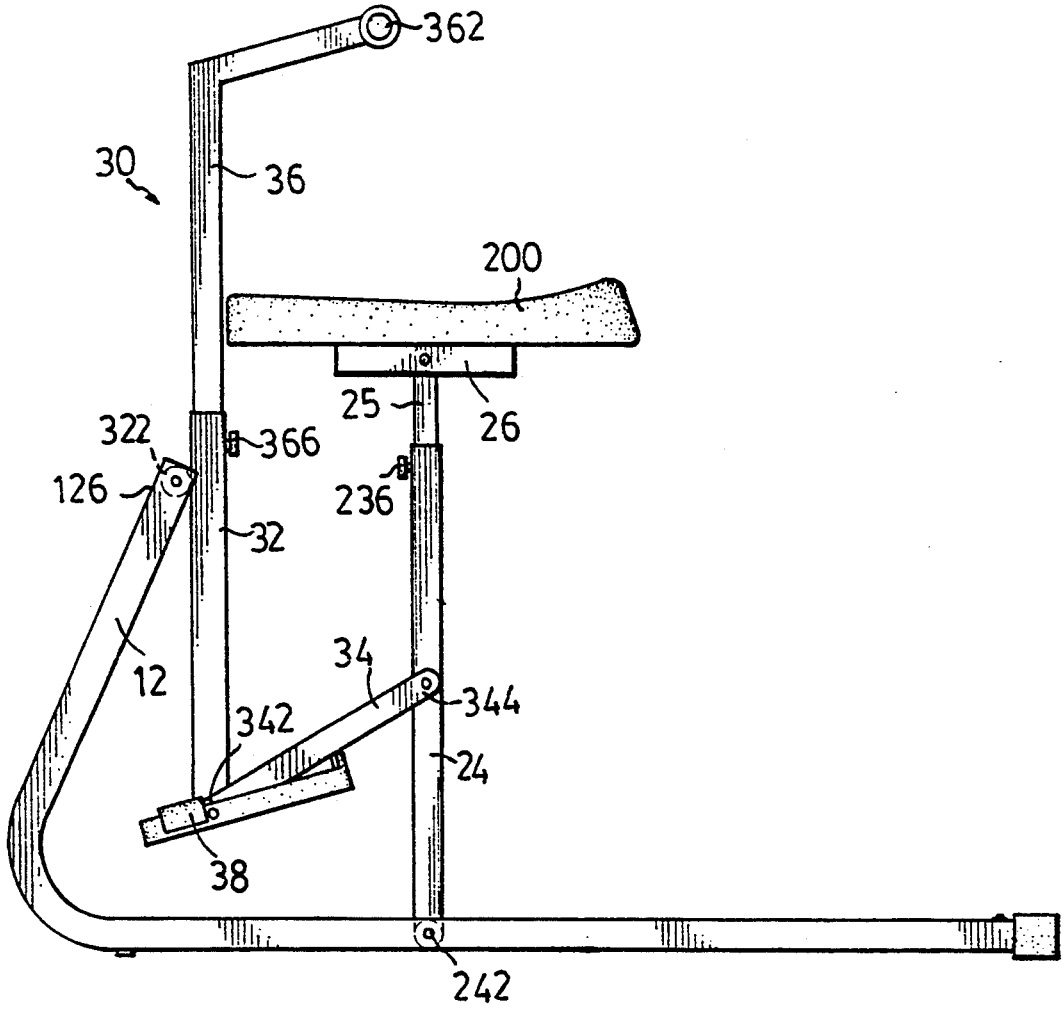
FIG. 5 is front plan view of the horse-riding type exerciser in accordance with a second embodiment of the present invention.

Referring to FIG. 5 , in accordance with a second embodiment of the present invention, the second seat post 22 is removed, that is to say, the seat element 200 and the bracket means 26 are directly supported by the first seat post 24 only.

Accordingly, by such an arrangement, the present invention provides a horse-riding type exerciser which has a simple structure and is able to easily perform its function in a simple transmission fashion. In addition, the present invention utilizes the user's bodily weight to form a natural resistance effect without using additional resistance means on the exerciser. Furthermore, it is possible for the present invention to produce a varying and adjustable resistance action by use of a plurality of weight elements. Additionally, the adjustability of height of the drive post means 30 and the seat element 200 results in that the present invention is suitable for users of different heights.

It should be clear to those skilled in the art that further embodiments of the present invention may be made without departing from the teachings of the present invention.

I claim:

1. A-horse-riding type exerciser comprising:

a base frame (10) having a first portion extending upwardly therefrom and a second portion;

a drive post means (30) having a mediate portion pivotally engaged with the first portion of said base frame (10) and having an upper portion (36) and a lower portion (32);

a handlebar (362) mounted to the upper portion (36) of said drive post means (30);

a pair of foot rests (38) pivotally mounted to the lower portion (32) of said drive post means (30);

a seat post means (20) having a lower portion pivotally engaged with said base frame (10) and an upper portion;

a bracket means (26) pivotally engaged with the upper portion of said seat post means (20);

a seat element (200) securely mounted on said bracket means (26); and a connecting means (34) having a first end (342) pivotally engaged with the lower portion (32) of said drive post means (30) and a second end (344) pivotally engaged with a mediate portion of said seat post means (20).

2. A horse-riding type exerciser comprising:

a base frame (10) comprising a pair of elongated beam elements (12) which each have a distal end (126) extending upwardly therefrom;

a drive post means (30) having a mediate portion pivotally engaged between said two distal ends (126) of said pair of beam elements (12) and having an upper portion (36) and a lower portion (32);

a handlebar (362) mounted to the upper portion (36) of said drive post means (30);

a pair of foot rests (38) pivotally mounted to the lower portion (32) of said drive post means (30);

a seat post means (20) having a lower portion pivotally engaged with said base frame (10) between said pair of beam elements (12) and an upper portion;

a bracket means (26) pivotally engaged with the upper portion of said seat post means (20);

a seat element (200) securely mounted on said bracket means (26); and a connecting means (34) having a first end (342) pivotally engaged with the lower portion (32) of said drive post means (30) and a second end (344) pivotally engaged with a mediate portion of said seat post means (20).

3. The horse-riding type exerciser in accordance with claim 2, further comprising a plurality of weight elements (42) mounted to an upper portion of said seat post means (20).

4. The horse-riding type exerciser in accordance with claim 2, wherein said upper portion (36) of said drive post means (30) is adjustably received in said lower portion (32) thereof.

5. The horse-riding type exerciser in accordance with claim 2, further comprising a first axle (242) and a second axle (222) rotatably mounted to said base frame (10) between said pair of beam elements (12), said seat post means (20) comprising a first seat post (24) which is pivotally engaged with the second end (344) of said connecting means (34) and a second seat post (22) respectively securely attached to said first and second axles (242) and (222) to pivot therewith, a first adjustable post (25) and a second adjustable post (23) being respectively adjustably received in said first and second seat posts (24) and (22) and being pivotally engaged with said bracket means (26).

6. The horse-riding type exerciser in accordance with claim 5, further comprising a rod (28) mounted to an upper portion of said second seat post (22).

* * * * *